United States Patent [19]

Kraft et al.

[11] 4,118,801

[45] Oct. 3, 1978

[54] RACK FOR VESSELS AND MEANS FOR AGITATING THE VESSELS IN THE RACK

[76] Inventors: Jack A. Kraft, 119 Elm La., New Hyde Park, N.Y. 11040; Harold D. Kraft, 147-14 70th Ave., Flushing, N.Y. 11367

[21] Appl. No.: 739,242

[22] Filed: Nov. 5, 1976

[51] Int. Cl.[2] ..... B01F 11/00

[52] U.S. Cl. ..... 366/111; 366/114; 366/116; 366/128; 366/208; 294/87.24

[58] Field of Search ..... 259/54, 55, 56, 72, 259/DIG. 42; 233/26; 294/87.22, 87.24, 87.26; 134/117, 137, 166 R; 211/74; 248/311.1

[56] References Cited

U.S. PATENT DOCUMENTS

| | | | |
|---|---|---|---|
| 856,619 | 6/1907 | Camp | 259/54 |
| 2,345,130 | 3/1944 | Latham | 259/54 |
| 2,355,004 | 8/1944 | McCulloch | 294/87.24 |
| 2,360,978 | 10/1944 | Putter | 211/74 |
| 3,061,280 | 10/1962 | Kraft et al. | 259/72 |

*Primary Examiner*—Harvey C. Hornsby
*Assistant Examiner*—Timothy F. Simone
*Attorney, Agent, or Firm*—Peter L. Berger

[57] ABSTRACT

A rack is provided for holding at least one vessel so that the vessel can be agitated by a drive means. The rack comprises means for resiliently clamping the vessel, the clamping means permitting the vessel to move with the clamping means defining the null point of the movement. Preferably, the clamping means is for resiliently clamping the vessel at a position remote from the bottom thereof and the rack further comprises laterally movable agitating means for engaging the vessel near the bottom thereof. Drive means are provided for imparting motion, such as orbital motion, to the agitating means whereby fluent contents of the vessel are agitated. Preferably, the apparatus is adapted for the holding and agitating of a plurality of vessels, such as a plurality of test tubes.

12 Claims, 7 Drawing Figures

RACK FOR VESSELS AND MEANS FOR AGITATING THE VESSELS IN THE RACK

BACKGROUND OF THE INVENTION

This invention relates to a rack for holding at least one vessel for agitation of the vessel thereby to mix fluent contents of the vessel. The invention also relates to the combination of such a rack with drive means for imparting such motion to the vessel or vessels in the rack as to effect the agitation.

Many laboratories require the mixing of fluent materials in vessels such as test tubes. Manual agitation is tedious and time-consuming. Various mechanical agitators have, therefore, come into existence. Many of these are deficient, however, in that they are not able to agitate the contents of a number of vessels simultaneously. Moreover, some do not thoroughly mix in a reasonable length of time the contents of even a single vessel, because the contents vortex and form strata.

It is an object of the present invention to provide apparatus which overcomes these and other disadvantages of the prior art.

Other objects and advantages of the invention will be apparent to one skilled in the art from the following description of the invention.

SUMMARY OF THE INVENTION

According to one aspect of the invention, there is provided a rack for holding at least one vessel for agitation of the vessel, the rack comprising means for resiliently clamping the vessel, the clamping means permitting the vessel to move with the clamping means defining the null point of the movement. Preferably, the clamping means is for resiliently clamping the vessel at a position remote from the bottom thereof and the rack further comprises laterally movable agitating means for engaging the vessel near the bottom thereof.

More particularly, the rack may comprise a frame and the clamping means may comprise a pair of opposed clamping members each having a resilient edge facing a resilient edge of the other clamping member, means laterally shiftably supporting the clamping members in the frame and means for laterally shifting at least one of the members between positions in which the clamping members do not clamp a vessel received therebetween and positions in which the clamping members are sufficiently close to each other so that they resiliently clamp a vessel received therebetween.

In an arrangement particularly well adapted for the holding of a plurality of vessels, such as test tubes, the clamping means comprises three clamping members. A first of the clamping members is arranged in the frame between the second and third clamping members. The first clamping member has a respective resilient edge at each of two opposite sides thereof, the second clamping member has a resilient edge facing one of the resilient edges of the first clamping member and the third clamping member has a resilient edge facing the other resilient edge of the first clamping member. The lateral shifting means comprises means for laterally shifting the second and third clamping members between positions sufficiently spaced from the first clamping member so that a vessel received between the first and the second or between the first and the third clamping members is not clamped therebetween and positions in which the clamping members are sufficiently close to each other that a vessel received between the first and the second or between the first and the third clamping members is clamped therebetween.

In a particularly effective arrangement for providing secure clamping according to the invention, the clamping means comprises a shaft, handle means rigidly mounted on the shaft for facilitating manual rotation of the shaft, a crossbar rigidly mounted on the shaft, first and second lever arms each pivotally connected near one end to the crossbar at a point near a respective end of the crossbar and each pivotally connected near the other end to a respective one of the second and third clamping members. One of the lever arms extends upwardly from the crossbar and the other lever arm extends downwardly from the crossbar. A vessel received between the first and the second or between the first and the third clamping members is clamped therebetween when the shaft is rotated sufficiently that a line connecting the points of pivotal connection of the lever arms to the crossbar has rotated from an orientation non-parallel in a first rotational sense to a plane common to the resilient edges of the second and third clamping members to an orientation non-parallel in a second rotational sense to the aforementioned common plane.

The agitating means may comprise a platform having recesses formed therein each for receiving a respective vessel. The platform may be connected to the frame by a plurality of resilient posts, the posts permitting lateral movement of the platform. Coupling means may be formed on the platform for engagement with means for driving the platform.

According to another aspect of the invention, there is provided a drive means for imparting motion to the agitating means. The drive means may comprise a frame, a platform, a plurality of resilient posts connecting the platform to the frame, a crank and a motor having a rotationally driven shaft, the motor shaft being connected to one end of the crank for driving the crank and the platform being connected to the other end of the crank, whereby rotation of the motor shaft imparts orbital motion to the platform. Means may be provided for releasably coupling the drive means platform and the rack platform so that the rack platform moves with the drive means platform. In particular, the coupling means may comprise bosses formed on the upper surface of the drive means platform and recesses formed in the lower surface of the rack platform for receiving the bosses.

The apparatus may also comprise means for releasably connecting the frame of the rack to the frame of the drive means whereby the frames remain stationary while motion is imparted to the platforms. The connecting means may comprise bosses on the bottom of the rack frame and members rigidly connected to the frame of the drive means and having recesses formed therein for receiving the bosses on the bottom of the rack frame.

DESCRIPTION OF A PREFERRED EMBODIMENT

The invention will now be further described by reference to a specific, preferred embodiment, as illustrated in the drawings, in which.

Figure 1:
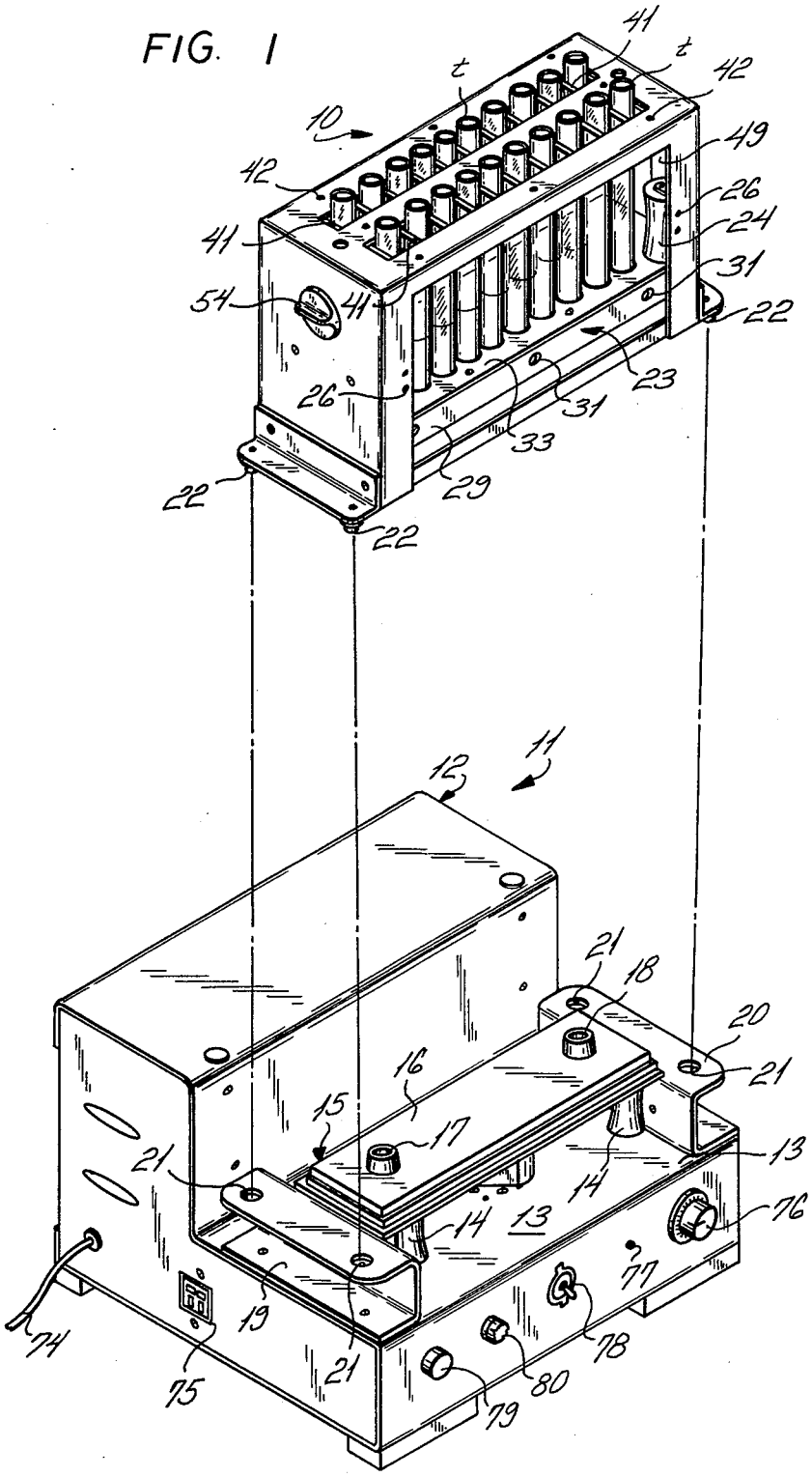
FIG. 1 is an exploded isometric view of the combination of a rack and drive means according to the invention.
Figure 2:
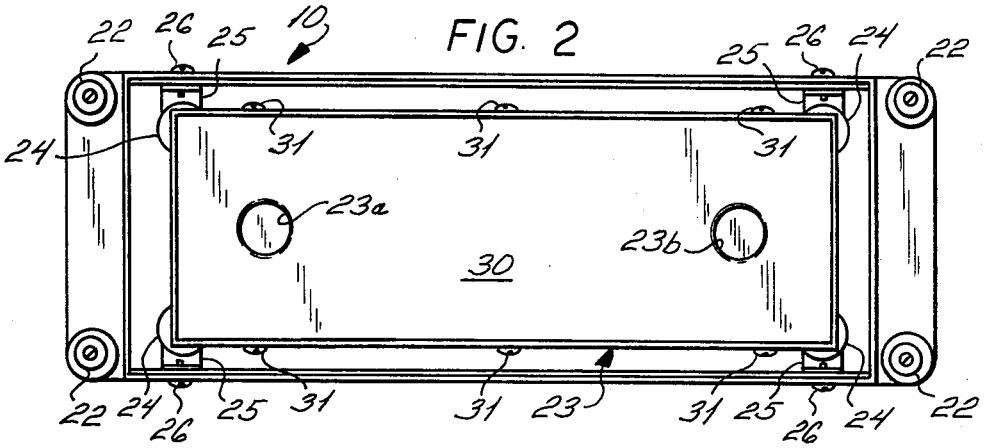
FIG. 2 is a plan view of the bottom of the rack.

The apparatus of FIG. 1 is comprised of a rack 10 and a drive means or base 11. The particular rack illustrated in FIG. 1 has a capacity of 20 test tubes, which are illustrated clamped in place in FIG. 1. The frame of the drive means is a sheet metal box 12. Mounted on the front top portion 13 of the box 12 by means of four resilient rubber posts 14 at the corners is a platform 15. The top 16 of the platform 15 is a rubber pad on which are fastened two rubber bosses 17 and 18. Alongside the platform 15, respective channel members 19 and 20 are fastened to the front top portion 13 of the box 12. Each channel member 19 and 20 is provided with a pair of apertures 21 which are sized and located to receive rubber bosses 22 provided at the corners of the bottom of the rack 10. The bosses 22 also serve as feet for the resting of the rack 10 on a surface when the rack 10 is not mounted on the drive means 11. The rack 10 is provided with a platform 23 and formed in the underside of the platform 23 are holes **23*a* and 23*b* (FIG. 2) for receiving the bosses 17 and 18 whereby the platform 23 may be coupled to the platform 15**.

Figure 3:
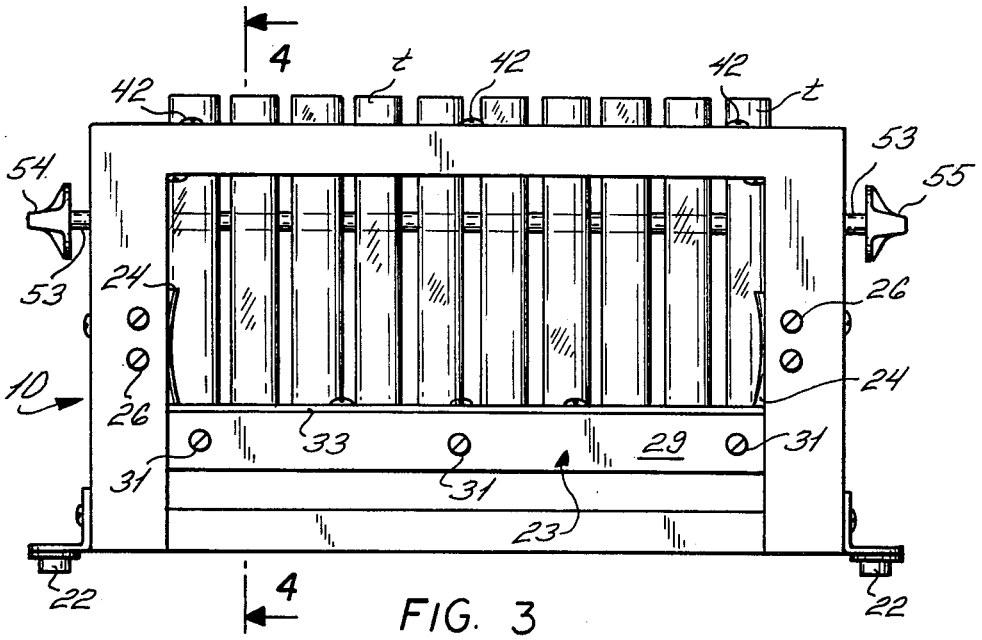
FIG. 3 is a front elevation of the rack with test tubes clamped in place.
Figure 4:
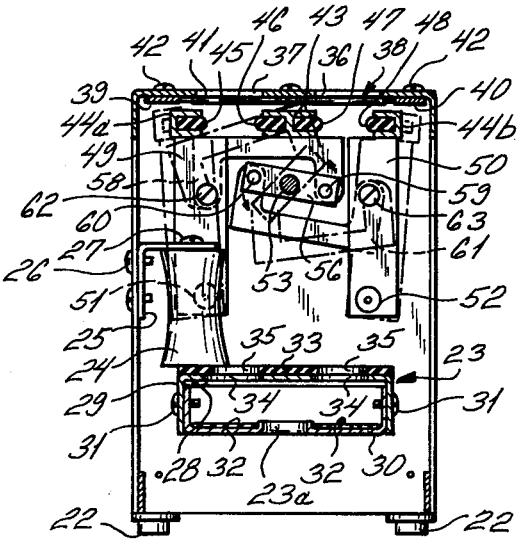
FIG. 4 is a section taken on section line 4—4 of FIG. 3, with the test tubes and one of the resilient posts omitted for clarity of illustration.

The platform 23 of the rack 10 is suspended from the sheet metal framework of the rack 10 by means of resilient rubber posts 24 fastened to the corners of the platform 23 (FIGS. 3 and 4). Each of the posts 24 is fastened to the frame of the rack by means of a respective bracket 25. Each bracket 25 is fastened to the frame of the rack by means of screws 26. A screw 27 fastens the resilient rubber post 24 to the bracket 25. A second, like screw 28 fastens the platform 23 to the post 24.

The platform 23 is fabricated of two sheet metal sections 29 and 30 having bent edges, the sheet metal sections 29 and 30 being fastened together by means of screws 31. The interior bottom surface of the section 30 is lined with a rubber sheet 32 through which the holes **23*a* and 23*b* extend as well as through the section 30. A rubber sheet 33 is fastened to the topmost surface of the platform 23. Circular apertures 34 are provided through the top of the section 29 and, axially aligned therewith, slightly smaller circular apertures 35 are provided through the rubber sheet 33. The number of respective apertures 34 and 35, namely, 20, corresponds to the test tube capacity of the rack 10**.

Figure 5:
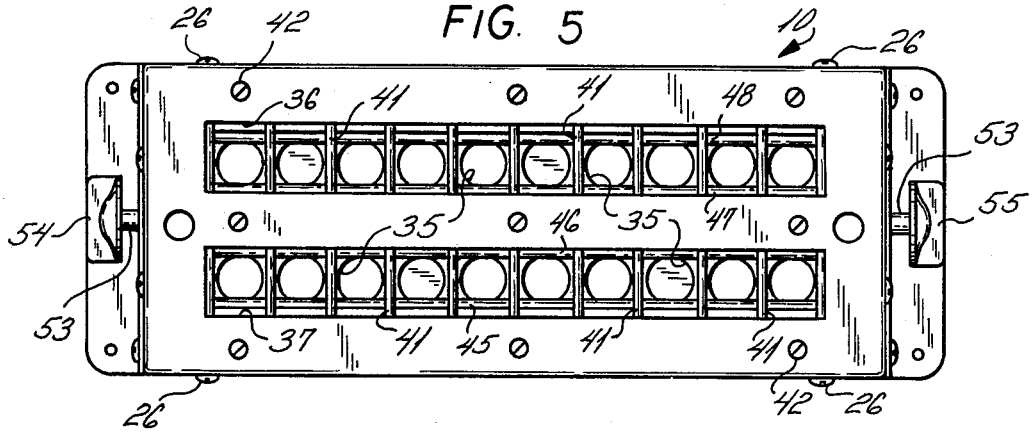
FIG. 5 is a plan view of the rack from the top.

A pair of elongated rectangular openings 36 and 37 is provided through the top of the frame of the rack 10 (FIG. 5). A spacer framework 38 having side rails 39 and 40 and crossrods 41 is fastened to the frame of the rack 10 by means of screws 42, which are received in tapped holes in the side rails 39 and 40.

Also associated with the frame of the rack 10 are three clamping members 43, **44*a* and 44*b*. The clamping members 44*a* and 44*b* are in the form of single-channels and the clamping member 43 is in the form of a double-channel. Respective lengths of rubber tubing 45, 46, 47 and 48 are pinched in the channels of the clamping members 44*a*, 43 and 44*b* (FIG. 4). The clamping member 43 is fastened to the frame of the rack 10 by means of screws. The clamping members 44*a* and 44*b* are laterally shiftably supported in a manner which will hereinafter be described. In particular, the arrangement is illustrated in FIG. 4. It is to be understood that a like arrangement is found at the other end of the rack 10**.

With reference to FIG. 4, it is seen that the clamping member **44*a* is fastened to the end of a lever arm 49 and the clamping member 44*b* is fastened to the end of a lever arm 50. The lever arm 49 is pivotally connected to an end wall of the frame of the rack 10 by means of a pivot pin 51 and the lever arm 50 is similarly pivotally mounted by means of a pivot pin 52. A shaft 53 extends the full length of the frame of the rack 10 (FIG. 3) and is rotatably supported in the end walls of the frame of the rack 10. Handles 54 and 55 are provided at the ends of the shaft 53 to facilitate manual turning of the shaft 53 (FIG. 3). A crossbar 56 is fixed to the shaft 53. A lever arm 58 is pivotally connected near one end thereof by means of a pivot pin 59 to the crossbar 56 near one end of the crossbar 56. The lever arm 58 extends upwardly from the crossbar 56. Also pivotally connected to the crossbar 56, near the other end thereof, by means of a pivot pin 60, is a lever arm 61 which extends downwardly from the crossbar 56. The other end of the lever arm 58 is pivotally connected to the lever arm 49 by means of a pivot pin 62, and the other end of the lever arm 61 is connected to the lever arm 50 by means of a pivot pin 63**.

In FIG. 4 the mechanism is illustrated in solid lines in a position in which the test tubes are clamped and in phantom in a position in which the test tubes are released. Hence, as viewed in FIG. 4, clamping of the test tubes requires clockwise turning of the shaft 53 and unclamping of the test tubes requires counterclockwise turning of the shaft 53.

The mechanism illustrated in FIG. 4 not only closes the clamping means but also locks the clamping means. As the shaft 53 is rotated clockwise (as viewed in FIG. 4) from a position in which the clamps are open to a position in which the clamps are closed, the clockwise rotation of the crossbar 56 causes the lever arms 58 and 61 to pull the lever arms 49 and 50, and therewith the clamping members 42 and 44, toward each other. The test tubes are then clamped between opposed pairs of resilient rubber tubes 45 and 46, as one pair, and 47 and 48, as the other pair. Imagining a horizontal plane passing through the centers of the tubes 45 and 48 and an imaginary line extending along the crossbar 56 from the center of the pivot pin 59 to the center of the pivot pin 60, it is seen that in the rotating of the crossbar 56 from a position in which the clamping members are open to a position in which the clamping members are closed, the imaginary line has rotated from an orientation non-parallel in a first rotational sense to the imaginary plane to an orientation non-parallel in a second rotational sense to the imaginary plane. This means that lateral forces applied to the clamping members 42 and 44 will apply a clockwise torque to the shaft 53 whereby the clamping members will not gradually open due to the lateral forces applied thereto by the test tubes. The resilient tubular sections 45, 46, 47 and 48 prevent the clamping members from damaging the test tubes. The cross rods 41 are sheathed with resilient plastic or rubber to prevent any possibility of damage to the test tubes by the cross rods 41.

The bottoms of the test tubes are received in the openings 35 in the rubber sheet 33 and the openings 34 in the sheet metal section 29 and rest on the rubber sheet 32. Because the diameter of the holes 35 is somewhat less than the diameter of the holes 34, the portion of each test tube which passes through the holes 34 and 35 is contacted only by rubber. Similarly, the very bottom of the test tube is contacted only by the rubber sheet 32. The possibility of breakage of the test tubes is, thus, minimized.

The suspending of the platform 23 from resilient posts 24 makes possible the imparting of lateral motion to the platform 23 for the purpose of agitating the test tubes and, thereby, mixing fluent contents of the test tubes. The flexibility of the resilient tubes 45, 46, 47 and 48 permits the test tubes to move in response to lateral forces applied by the edges of the holes 35 without breaking.

Figure 6:
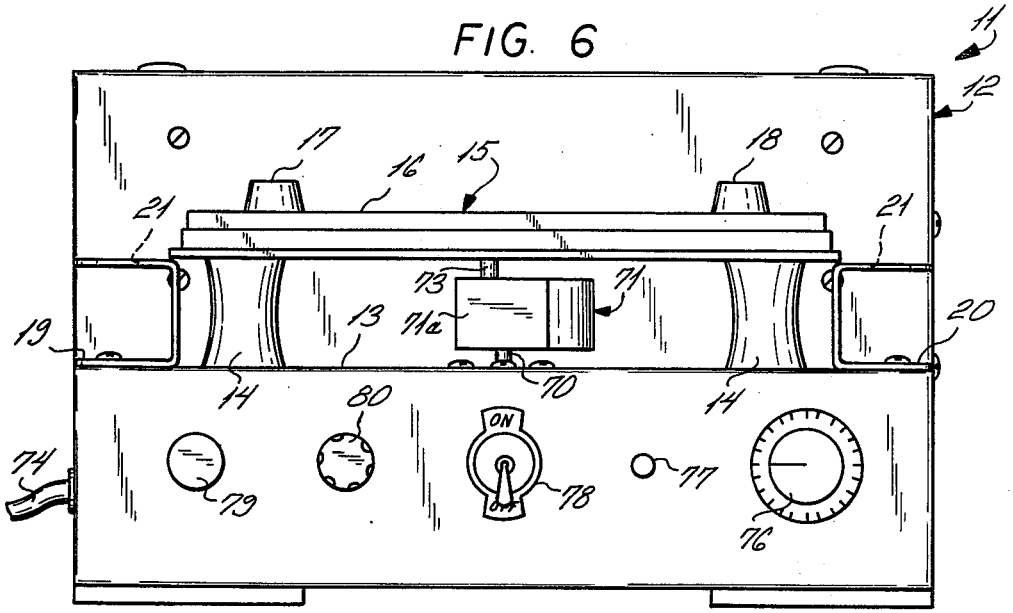
FIG. 6 is a front elevation of the drive means.
Figure 7:
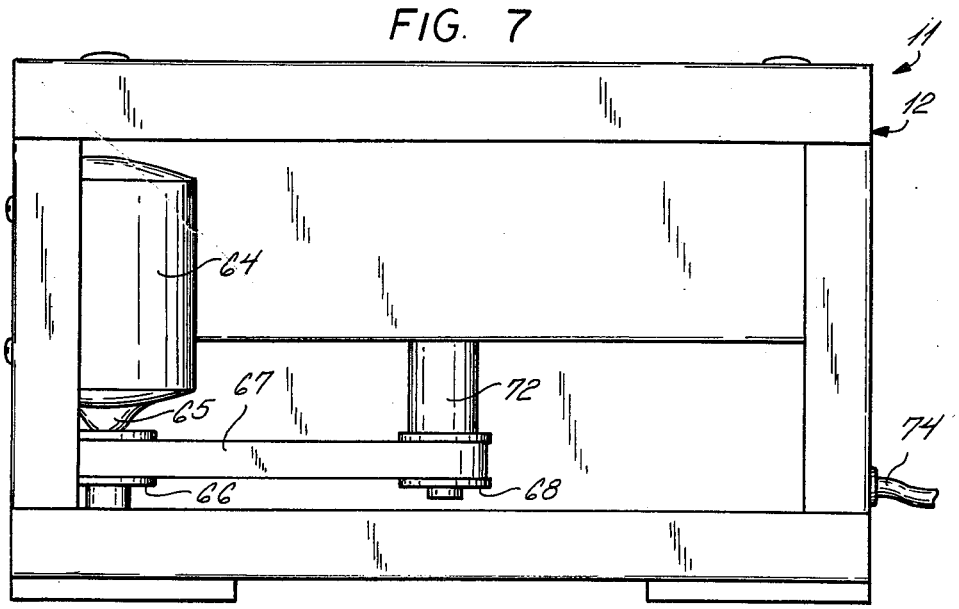
FIG. 7 is a back elevation of the drive means.

It can readily be seen that mounting of the rack 10 on the driving means 11 in the manner hereinabove described results in the frame of the rack 10 being fixedly connected to the frame of the driving means 11 while the platform 23 of the rack 10 is movable with the platform 15 of the driving means 11. With reference to FIGS. 6 and 7, it is seen that the drive train for the platform 15 consists of an electric motor 64 having a drive shaft 65 mounting a timing pulley 66 connected by means of a timing belt 67 to a timing pulley 68, the timing pulley 68 being connected to an arm 70 of an eccentric 71, the arm 70 being rotatably mounted in a bearing 72. The other arm 73 of the eccentric 71 is pivotally connected to the platform 15. Consequently, actuation of the motor 64 results in an orbital motion being imparted to the platform 15 and, therefore, to the platform 23. Agitation of the clamped test tubes and consequent mixing of the fluent thereof result.

A power cord 74 for plugging into an outlet is, of course, provided. Also, a socket 75 for remote control of the apparatus is provided. The motor drive is controlled by an electronic solid state variable speed control 76. A pilot light 77 is provided to indicate an "on" condition of the apparatus. An off-on toggle switch 78 and a momentary push-button switch 79 are included in the circuitry to ease the machine operation under various conditions. The front panel also includes a switch 80 which actuates conventional electronic means for actuating the motor in pulses. It has been found that pulsed driving of the agitating means facilitates homogeous mixing in that stratification in the vessel is avoided. Conventional electronic means for accomplishing such pulsing, optional with conventional means for adjusting the period of the pulses, may be included in the circuitry of the apparatus.

While the invention has been described with reference to a specific, preferred embodiment, it will be understood that modifications and variations obvious to one skilled in the art are intended to be encompassed within the scope of the invention as defined by the hereto appended claims. For example, motions other than orbital, such as reciprocal, may be imparted to the platform.

What is claimed is:

1. A rack for holding at least one vessel for agitation of the vessel, said rack comprising: resilient clamping means comprising resilient members formed of resilient material for holding said vessel to said rack, positive-action movable means attached to said clamping means for moving said resilient members against the vessel at a position remote from the bottom thereof to resiliently hold the vessel vertically in place, laterally movable agitating means for engaging the vessel near the bottom thereof for imparting a lateral movement to the bottom of said vessel, said clamping means clamping said vessel to said rack and defining a null point while said lateral movement is imparted to said vessel, said rack further comprising a frame, said clamping means comprising three clamping members, a first of the clamping members being arranged in the frame between the second and third clamping members, the first clamping member having a respective resilient edge at each of two opposite sides thereof, the second clamping member having a resilient edge facing one of the resilient edges of the first clamping member and the third clamping member having a resilient edge facing the other resilient edge of the first clamping member and lateral shifting means comprising means for laterally shifting the second and third clamping members between positions sufficiently spaced from the third clamping member so that a vessel received between the first and the second clamping members or between the first and the third clamping members is not clamped therebetween and positions in which the clamping members are sufficiently close to each other that a vessel received between the first and second clamping members or between the first and the third clamping members is clamped therebetween, said clamping means further comprising a shaft, handle means rigidly mounted on the shaft for facilitating manual rotation of the shaft, a cross bar rigidly mounted on the shaft, first and second lever arms each pivotally connected near one end to the cross bar at a point near a respective end of the cross bar and each pivotally connected near the other end to a respective one of the first and second clamping members, one of the lever arms extending upwardly from the cross bar and the other lever arm extending downwardly from the cross bar, whereby a vessel received between the first and the second clamping members or between the first and the third clamping members is clamped therebetween when the shaft is rotated sufficiently that a line connecting the points of pivotal connection of the lever arms to the cross bar has rotated from an orientation non-parallel in a first rotational sense to a plane common to the resilient edges of the second and third clamping members to an orientation non-parallel in a second rotational sense to said common plane.

2. A rack according to claim 1, in which the agitating means comprises a platform, the platform having recesses formed therein each for receiving a respective vessel.

3. A rack according to claim 1, comprising a plurality of resilient posts connecting the platform to the frame, said posts permitting lateral movement of the platform.

4. A rack according to claim 3, comprising coupling means formed on the platform for engagement with means for driving the platform.

5. In combination, a rack according to claim 1 and drive means for imparting motion to the agitating means.

6. A combination according to claim 5, in which the agitating means comprises a platform, the platform having recesses formed therein each for receiving a respective vessel.

7. A combination according to claim 6, in which the drive means comprises a frame, a platform, a plurality of resilient posts connecting the platform to the frame, a crank and a motor having a rotationally driven shaft, the motor shaft being connected to one end of the crank for driving the crank and the platform being connected to the other end of the crank, whereby rotation of the motor shaft imparts orbital motion to the platform.

8. A combination according to claim 7, comprising means for releasably coupling the drive means platform and the rack platform so that the rack platform moves with the drive means platform.

9. A combination according to claim 8, in which the coupling means comprises bosses formed on the upper surface of the drive means platform and recesses formed in the lower surface of the rack platform for receiving the bosses.

10. A combination according to claim 9, comprising means for releasably connecting the frame of the rack to the frame of the drive means whereby the frames remain stationary while motion is imparted to the platforms.

11. A combination according to claim 10, in which the connecting means comprise bosses on the bottom of the rack frame and members rigidly connected to the frame of the drive means and having recesses formed therein for receiving the bosses on the bottom of the rack frame.

12. A combination according to claim 5, comprising means for pulsing the drive means.

* * * * *